US006266010B1

(12) United States Patent
Ammar et al.

(10) Patent No.: US 6,266,010 B1
(45) Date of Patent: Jul. 24, 2001

(54) METHOD AND APPARATUS FOR TRANSMITTING AND RECEIVING SIGNALS USING ELECTRONIC BEAM FORMING

(75) Inventors: Danny F. Ammar, Windermere; Vernon Brady, Orlando, both of FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/397,105

(22) Filed: Sep. 16, 1999

(51) Int. Cl.[7] ..... H01Q 3/02; H01Q 3/12
(52) U.S. Cl. ..... 342/374
(58) Field of Search ..... 342/368, 373, 342/374

(56) References Cited

U.S. PATENT DOCUMENTS

| | | | |
|---|---|---|---|
| 4,032,922 | 6/1977 | Provencher . | |
| 4,499,472 | 2/1985 | Willett . | |
| 4,626,858 | 12/1986 | Copeland . | |
| 4,893,126 | 1/1990 | Evans . | |
| 5,115,245 | 5/1992 | Wen et al. . | |
| 5,486,832 | 1/1996 | Hulderman . | |
| 5,495,255 | 2/1996 | Komatsu et al. . | |
| 5,657,024 | 8/1997 | Shingyoji et al. . | |
| 5,684,491 | * 11/1997 | Newman et al. | 342/374 |
| 5,691,729 | 11/1997 | Gutman et al. . | |

* cited by examiner

*Primary Examiner*—Thomas H. Tarcza
*Assistant Examiner*—Fred H. Mull

(74) *Attorney, Agent, or Firm*—Burns, Doane, Swecker & Mathis, LLP

(57) ABSTRACT

The present invention is directed to providing an antenna system for transmitting and receiving signals in a manner which eliminates the extensive hardware, high cost and complexity of the transmitter, receiver or transceiver used in conventional systems. Exemplary embodiments are directed to an antenna system which uses electronic beam forming to mathematically synthesize the signals desired for object detection and tracking. Rather than using passive waveguide material having multiple antenna system ports that must be individually processed in separate transceiver channels, exemplary embodiments of the present invention are directed to an antenna system wherein the antenna ports are coupled to a beam forming network of the antenna system. The beam forming network includes a single port that can be coupled to a single transceiver channel. The beam forming network is configured to mathematically synthesize each of the desired signals needed by the transceiver to calculate desired information, such as the azimuth and elevation of an object to be detected and/or tracked (for example, the summed output signal and a difference output signal). The beam forming network can be configured to sequentially produce each of the desired signals. Alternately, the beam forming network can provide desired signals from the transceiver channel to the multiple antenna ports during a transmit operation. Exemplary embodiments are applicable to any systems which involve the use of an antenna systems, including, but not limited to, communication systems and radar applications. Exemplary embodiments can provide any of the functionality typically associated with beam forming antennae including, but not limited to communications such as satellite to ground communications, beam shaping, and beam pointing.

18 Claims, 2 Drawing Sheets

METHOD AND APPARATUS FOR TRANSMITTING AND RECEIVING SIGNALS USING ELECTRONIC BEAM FORMING

BACKGROUND OF THE INVENTION

1. Field of the Invention

The present invention relates generally to systems for transmitting and receiving information, and more particularly, to antenna systems for transmitting and receiving signals using electronic beam forming. Exemplary embodiments are applicable to any situation where antennae are used including, but not limited to, any communication systems that involve wireless transmission or reception of signals.

2. Background Information

Antenna systems for transmitting and receiving information are used for a variety of applications, including wireless communication system applications and radar applications which involve object detection and tracking. These antenna systems are typically configured to accommodate the sequential channel processing associated with low cost radio frequency (RF) seeker applications (that is, object detection and tracking), among other radar applications.

A typical antenna system suitable for these radar applications is a cassegrain antenna system, wherein the antenna includes multiple output ports. A conventional cassegrain antenna system also includes waveguide material, known in the art as a "magic T", to passively (that is, without electronic components) provide multiple antenna system outputs. For example, a typical four channel cassegrain antenna supplies A, B, C and D signals from the antenna output ports to the waveguide material of the antenna system. The waveguide material can be a plurality of magic T's. The waveguide material includes a plurality of antenna system ports, which can provide or receive the variety of signals that are of interest to various applications for which the antenna is to be used.

For example, output signals from the waveguide material can include a summed output signal: A+B+C+D, and a differential output signal: A+B−C−D or A+C−B−D. The summed output signal and the differential output signal can be combined in a transceiver to provide, for example, monopulse indications of the azimuth and elevation of an object to be detected and/or tracked.

Because the cassegrain antenna system uses waveguide material to produce output signals of interest at a plurality of separate antenna system ports, a transceiver which receives the signals to produce the azimuth and elevation information, or which supplies signals to the antenna, must be configured as a multichannel transceiver. The transceiver must have a separate channel for each port of the antenna system's waveguide material to provide the desired active and passive tracking functions for which the antenna system is to be used. These multichannel transceivers are complex and costly because of the active components they require to provide the multichannel functionality. Moreover, each of the multichannel paths in the transceiver must be calibrated independently, and repeatedly recalibrated to ensure accurate, reliable operation, thus adding to the cost and complexity of the transceiver.

Accordingly, it would be desirable to provide an antenna system for receiving and transmitting signals which is suitable for a variety of applications including, but not limited to, communication systems and radar systems, but which does not require the associated transmitter, receiver or transceiver to possess the hardware, high cost and circuit complexity of conventional systems.

SUMMARY OF THE INVENTION

The present invention is directed to providing an antenna system for transmitting and receiving signals in a manner which eliminates the extensive hardware, high cost and complexity of the transmitter, receiver or transceiver used in conventional systems. Exemplary embodiments are directed to an antenna system which uses electronic beam forming to mathematically synthesize the signals desired for reception or transmission. Rather than using passive waveguide material having multiple antenna system ports that must be individually processed in separate transceiver channels, exemplary embodiments of the present invention are directed to an antenna system wherein the antenna ports are coupled to a beam forming network of the antenna system. The beam forming network includes a single port that can be coupled to a single transceiver channel.

The beam forming network is configured to mathematically synthesize each of the desired signals needed by the transceiver to calculate desired information, such as the azimuth and elevation of an object to be detected and/or tracked (for example, the summed output signal and a difference output signal). The beam forming network can be configured to sequentially produce each of the desired signals. Alternately, the beam forming network can provide desired signals from the transceiver channel to the multiple antenna ports during a transmit operation.

Exemplary embodiments are applicable to any systems which involve the use of an antenna systems, including, but not limited to, communication systems and radar applications. Exemplary embodiments can provide any of the functionality typically associated with beam forming antennae including, but not limited to communications such as satellite to ground communications, beam shaping, and beam pointing.

Generally speaking, exemplary embodiments of the present invention relate to a method and associated apparatus for at least one of transmitting and receiving signals. Exemplary embodiments include, among other features, an antenna having a plurality of antenna ports; and a beam forming means for sequentially interfacing said plurality of antenna ports to a single antenna system port, said forming means being reconfigurable to synthesize signals at one of said plurality of antenna ports and said single antenna system port from signals at the other of said plurality of antenna ports and said single antenna system port. The single antenna system port can be coupled to a transmitter or receiver configured with a single channel for interfacing with the beam forming means.

BRIEF DESCRIPTION OF THE DRAWINGS

Other objects and advantages of the present invention will become apparent to those skilled in the art upon reading the following detailed description of preferred embodiments, in conjunction with the accompanying drawings, wherein like reference numerals have been used to designate like elements, and wherein.

DETAILED DESCRIPTION OF THE PREFERRED EMBODIMENTS

Figure 1:
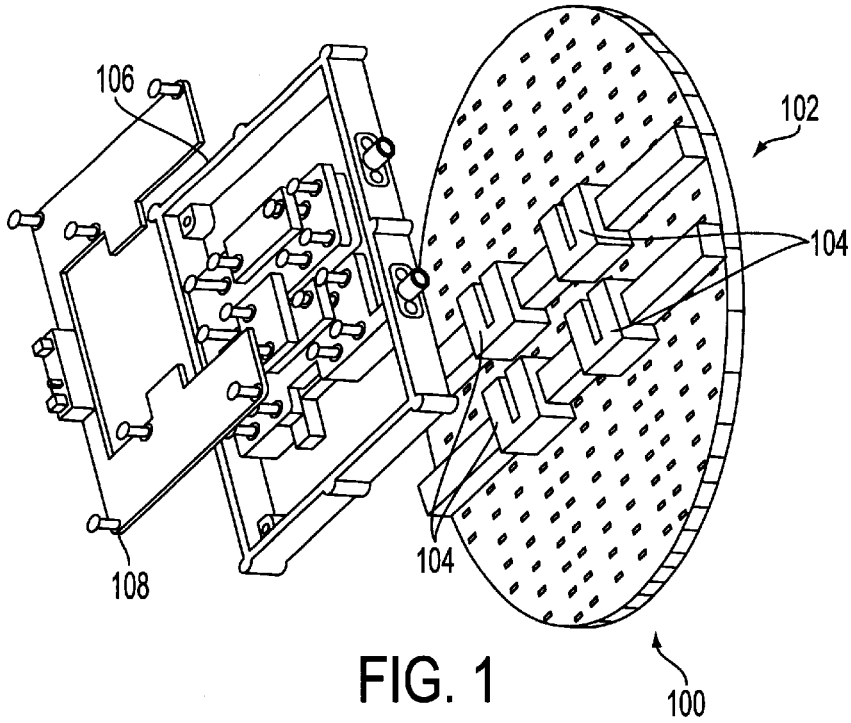
FIG. 1 shows an antenna system having an antenna and beam forming network configured in accordance with an exemplary embodiment of the present invention.

FIG. 1 shows an apparatus, represented as an antenna system 100 for at least one of transmitting and receiving signals. In the FIG. 1 embodiment, the antenna system 100 includes an antenna plate 102 configured as a flat plate antenna having a plurality of antenna ports. In FIG. 1, four such antenna ports 104 are provided. These ports can be used to interface quadrature outputs of the antenna with a beam forming means. Such an antenna plate, as modified in accordance with an exemplary embodiment of the present invention, can be machined from aluminum, and produced, for example, by Litton Airtron, Inc.

The antenna system 100 uses the beam forming means for sequentially interfacing said plurality of antenna ports with a single antenna system port, the beam forming means being represented as a beam forming network 106, and being reconfigurable to synthesize signals at one of the plurality of antenna ports and the single antenna system port from signals at the other of the plurality of antenna ports and the single antenna system port. The inclusion of the beam forming network 106 results in the antenna system being configured as a single output device which provides sequential beam forming that permits a single channel receiver to be used. The beam forming network mathematically synthesizes a desired beam by selectively combining the outputs from the plurality of antenna ports, such as the four quadrants in FIG. 1. The beam forming network includes a variety of different signal paths and internal switches which can be repeatedly reconfigured to sequentially synthesize different output signals. The beam forming network 106 can be held in place to the back side of the antenna plate 102 using any attachment mechanism including, but not limited to screws.

A circuit card assembly 108 (for example, a printed circuit board) of suitable drivers and control electronics is provided to control the switches of the beam forming network. For example, a software word is supplied to an input port of the circuit card assembly. The software word is used to control the switches of the beam forming network to determine a particular configuration of paths within the beam forming network. The circuit card assembly can, for example, be a programmable logic array which translates different software words into different sets of switch positions.

An antenna system as configured in accordance with exemplary FIG. 1 embodiment can be easily and cost effectively configured. In addition, because the antenna system can interface with a transceiver via a single antenna system port, the transceiver can be cost effectively configured as a single channel device. An antenna system configured in accordance with exemplary embodiments of the present invention provides superior performance, and permits low cost commercially available transceivers to be used, yet achieves the equivalent or higher performance than existing antenna systems used, for example, in radar applications. Because a conventional receiver, transmitter or transceiver can be used in accordance with exemplary embodiments of the present invention to sequentially process the sequential outputs from the antenna system, details of the transceiver need not be provided herein, but will be apparent to those skilled in the art. However, in accordance with exemplary embodiments, the transceiver can be configured in accordance with a transceiver as described in co-pending U.S. application Ser. No. 09/185,579, entitled METHOD AND APPARATUS FOR HIGH FREQUENCY WIRELESS COMMUNICATION, the contents of which are hereby incorporated by reference.

Figure 2:
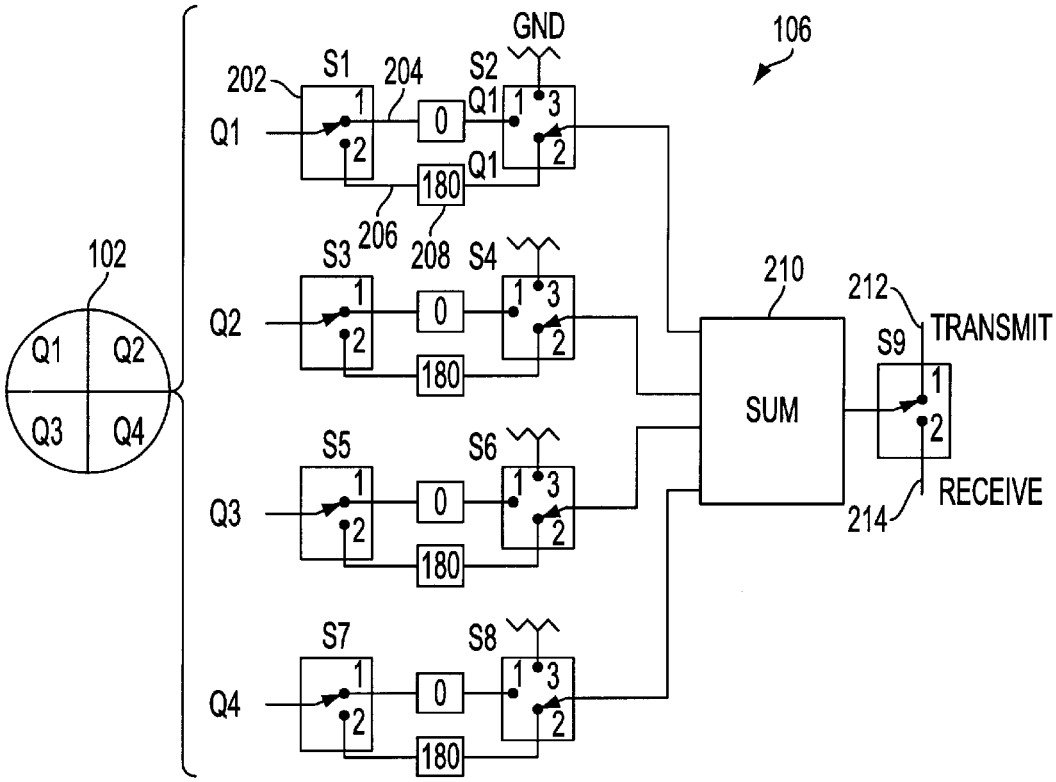
FIG. 2 shows an exemplary antenna beam forming network of the present invention for use in the exemplary antenna system of FIG. 1.

Details of the exemplary beam forming network 106 will now be described in greater specificity with respect to FIG. 2. In FIG. 2, the antenna plate 102 is shown as an exemplary four quadrant antenna, with each quadrant being labeled Q1–Q4. Each quadrant is connected with one of the four antenna ports 104 described with respect to FIG. 1.

As can be seen in FIG. 2, each of the antenna ports labeled Q1–Q4 is coupled with the beam forming network 106 via a plurality of switches 202. Each of the switches 202 is labeled S1–S9. The four quadrants from the antenna 102 are coupled, respectively, to each of the switches S1, S3, S5 and S7. Each of the switches 202 can be configured using any desired switch readily available. For purposes of explanation, the exemplary embodiment illustrated in FIG. 2 is configured using switches, such as pin diode switches. The pin diodes can be those available from, for example, Alpha and MA/com or any other manufacturer. Each of the switches S1, S3, S5 and S7 can be selectively controlled to couple a respective one of the quadrature antenna ports with either a 0° degree phase shift path, such as path 204 associated with switch S1, or a 180° phase shift path, such as path 206 associated with switch S1. The path 206 includes a phase shifter 208. Each of the paths 204 and 206 is configured with a pair of switches. For example, the first path is defined by switch S1 and associated switch S2. Each of the remaining paths associated with the switches S3–S8 is similarly configured.

As those skilled in the art will appreciate, the phase shifter constitutes a backbone of the beam forming network 106. By selectively combining output signals from the quadrature RF antenna ports with a phase of either 0°or 180°, object detection and tracking can be achieved. The phase shifter can provide equal amplitude, anti-phase capabilities for channel synthesis to permit the antenna system to sequentially produce a plurality of different output signals needed by the receiver or transceiver to perform a desired function.

Each 180° phase shifter can be configured as a 3 decibel branch-line coupler and two open-end stubs. The material used for the phase shifter can be any desired thick film, thin film, or RF material including, but not limited to, Rogers RT 5880™ material, copper (Cu) clad 0.005 inches total thickness with an $\epsilon_R$ of 2.2 and a loss tangent of 0.0009. Such a material has low insertion loss and is highly cost efficient.

In accordance with an exemplary embodiment, the phase shifter 208 can be implemented as a path length increasing phase shifter, manufactured out of any thin film (e.g., quartz, duriod, fused silica, alumina and so forth). With such a device, a phase shift is achieved by varying path length. For example, with respect to the antenna port Q1, the signal travels a further distance from the switch S1 to the input of a downstream switch S2. In the case of millimeter waves supplied to or from the antenna 102, wherein the wavelength is on the order of 0.0086 meters, a 180° phase shift can be achieved by increasing the path length along the path length 206 relative to the path 204, by $\lambda/2$, wherein $\lambda$ constitutes the wavelength.

Those skilled in the art will appreciate that exemplary embodiments of the present invention are not limited to the paths 204, 206 being configured as described above. Rather, those skilled in the art will appreciate that any paths between the antenna ports and the antenna system port which can provide a phase differential of 180° can be used. For example, paths configured with an appropriate switch or switches to permit a selection of either a particular signal or an inversion of the signal, can be used.

A 35 gigahertz coupler can be used between the antenna and the beam forming network, such that signals exiting antenna ports (for example, ports 3 and 4 of the antenna associated with quadrants Q3 and Q4) are amplitude and phase balanced when other antenna ports (for example, antenna port 1 associated with Q1) are excited. The return loss is less than, for example, −20 decibels, at the operating frequency.

As already mentioned, the paths 204 and 206 are coupled, in the case of the quadrature output Q1, to a switch S2 having four terminals. The first two terminals are coupled with the unshifted and the phase shifted paths 204 and 206, respectively. A third terminal is connected to ground. An output terminal of the switch S2 is coupled to a summing device 210 which, in exemplary embodiments, includes at least one power divider. Exemplary embodiments use Wilkinson dividers as power splitter/combiners, because of their easy fit and low loss capability. The divider can, for example, be configured from alumina 0.005 inches thick with an $\epsilon_R$ of 9.9 and a loss tangent of 0.015. Such a material permits integral resistor fabrication for reduced costs and increased reliability. However, any divider can be used, including, but not limited to quarter wavelength ($\lambda/4$) straight lines, or lines with curves and bends used to reduce the effective coupling. Power dividers with an exemplary minimal loss on the order of −3.3 decibels and rejection capabilities of less than 20 decibels can be used. In the FIG. 2 embodiment, the summing device includes three power splitter/combiners to produce four outputs on the antenna side of the summing device from one input on the transceiver side, each of the four outputs being of equal phase and amplitude.

Each of the remaining paths associated with the quadrature antenna ports Q2–Q4 are coupled to the summing device 210. The summing device is coupled to yet another switch S9, also configured as one of the pin diodes switches 202. The switch S9 is connected to a transmit port 212 and/or a receive port 214, and is used to select either a transmit or a receive operation with respect to a transmitter/receiver or transceiver coupled to the switch S9.

Because various signals from the antenna ports (that is, Q1–Q4) can be combined or synthesized in any of a variety of different combinations based on the settings of the various switches S1–S9, the beam forming network 106 can be repeatedly, and sequentially reconfigured to supply a variety of different signals from the antenna to the single antenna system output (i.e., represented as the transmit/receive output of switch S9). Alternately, a variety of different signals can be received from a transmitter at switch S9, and supplied, through the beam forming network, to the quadrature antenna ports (that is, Q1–Q4) to transmit signals which have been mathematically synthesized by the beam forming network. The transmitter, receiver or transceiver can thus be configured as a single channel device, although a receiver, transmitter and/or transceiver having any number of channels can, of course, be used. The receiver, transmitter and/or transceiver can be configured in any known fashion, provided only that the transmitter, receiver or transceiver is configured to interface with the sequential operation of the antenna system configured in accordance with exemplary embodiments of the present invention.

Figure 3A:
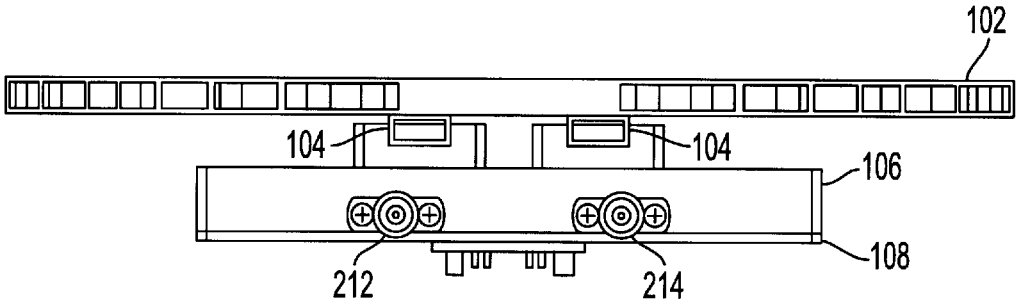
FIGS. 3A and 3B show an exemplary embodiment of the beam forming network layout of FIG. 1.
Figure 3B:
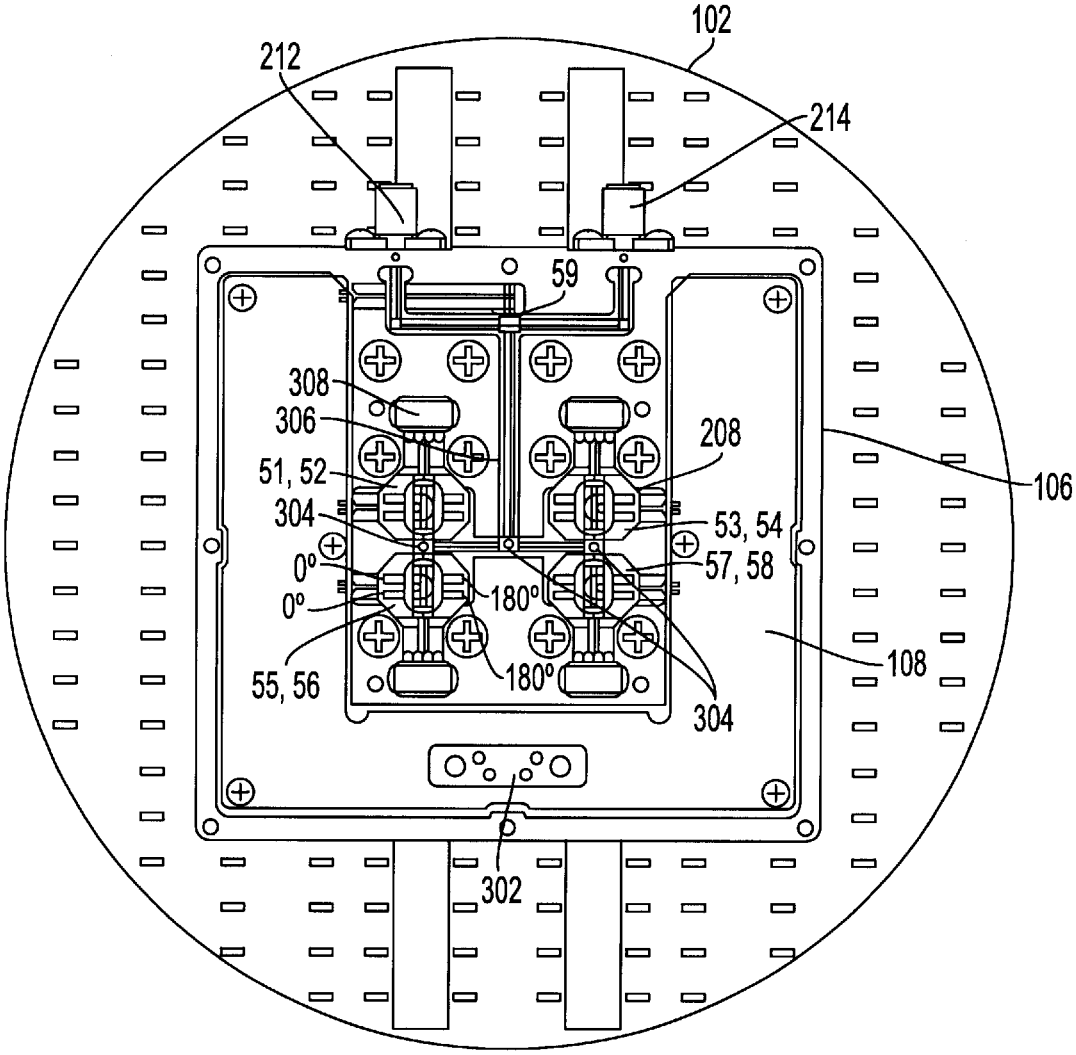

FIGS. 3A and 3B show a top view and a back view of the assembled FIG. 1 antenna system. As can be seen in FIG. 3B, the circuit card assembly 108 includes a digital control connector 302 for interfacing the circuit card assembly with an input cable that supplies the software word(s) to the circuit card assembly to control the position of switches S1–S9. Power dividers 304 of the summing device 210 can be seen in FIG. 3B. The signal paths of the FIG. 2 beam forming network are illustrated as the microstrip transmission lines 306 in FIG. 3B. Waveguide transitions labeled 308 in FIG. 3B are provided to transition between the waveguide material used for the antenna ports 104 and the microstrip transition lines 306. As can be seen in FIG. 3B, each of the switches S1–S8 are grouped in pairs. For example, in the upper left quadrant of the beam forming network 106 as shown in FIG. 3B, the switches S1/S2 are provided, each producing a 0° path to the left side of the Figure and producing a 180° phase shift in a path shown to the right in the Figure. In a clockwise direction, the remaining quadrants include the switches S3, S4, S7/S8 and S5/S6. FIG. 3B also shows the three power dividers described with respect to an exemplary embodiment of the FIG. 2 summing device 210.

In accordance with exemplary embodiments, each of the switches S1–S9 is selectively controlled in response to a software word supplied to the circuit card assembly 108 via the digital control connector 302 Signals from the quadrature antenna ports Q1–Q4. are selectively combined to produce an appropriate, mathematical synthesis of outputs desired for a function to be implemented by the transceiver, or to be broadcast by the antenna. For example, the following table sets forth exemplary settings of switches S1–S9 to achieve various functions when the antenna system is in a transmit mode (see row 1), or in a receive mode (see rows 2–11) wherein signals received at the antenna ports are selectively combined to produce desired outputs at the single antenna system output. As those skilled in the art will appreciate, each row of the following table can be produced in response to a particular software word input to the circuit card assembly to in turn drive each of the switches S1–S9 to a desired position.

| Channel/Switch | S1 | S2 | S3 | S4 | S5 | S6 | S7 | S8 | S9 |
|---|---|---|---|---|---|---|---|---|---|
| Sum Transmit | 1 | 1 | 1 | 1 | 1 | 1 | 1 | 1 | 1 |
| Sum Receive | 1 | 1 | 1 | 1 | 1 | 1 | 1 | 1 | 2 |
| Delta Elevation | 1 | 1 | 1 | 1 | 2 | 2 | 2 | 2 | 2 |
| Delta Azimuth | 1 | 1 | 2 | 2 | 1 | 1 | 2 | 2 | 2 |
| TH Elevation | 1 | 1 | 1 | 1 | — | 3 | — | 3 | 2 |
| LH Elevation | — | 3 | — | 3 | 1 | 1 | 1 | 1 | 2 |
| RH Azimuth | — | 3 | 1 | 1 | — | 3 | 1 | 1 | 2 |
| LH Azimuth | — | 1 | — | 3 | 1 | 1 | — | 3 | 2 |
| DL | 1 | 1 | — | 3 | — | 3 | 1 | 1 | 2 |
| DR | — | 3 | 1 | 1 | 1 | 1 | — | 3 | 2 |
| Q1 | 1 | 1 | — | 3 | — | 3 | — | 3 | 2 |

As can be seen from the above table, to implement a sum transmit wherein any two or more of the quadrature antenna output signals are produced by additively combining signals, the switches S1–S9 are all placed to switch location "1", such that no phase shifts are introduced to the antenna output signals by the beam forming network. The table also shows switch settings for a sum receive (e.g., an output A+B+C+D, wherein each of the A–D outputs are from a respective quadrature antenna port 102), a delta elevation, and a delta azimuth.

Where, for example, the user wishes to provide other functions such as the tracking of an object having an external emitter, less than all of the antenna ports can be used in synthesizing desired signals for the receiver or transceiver.

For example, the tracking of an object having an external emitter can involve outputting signals from the beam forming network 106 representing only a portion of inputs to the antenna. These signals are represented in the above table by the switch settings in rows 5–8. That is, in row 5, a top half (TH) elevation signal is output from the beam forming network using only signals received in the upper half of the antenna (that is, quadrants Q1 and Q2) of the antenna. To produce this signal, the lower half of the antenna is shunted, as represented by switches S5 and S7 being placed to open positions. A next sequential signal produced by the beam forming network can be a lower half (LH) elevation signal generated by shunting the upper two quadrants of the antenna, and producing an output signal based on the antenna signals from quadrants Q3 and Q4. In this case, switches S1 and S3 are left open. The two signals sequentially produced by the beam forming network can be used to calculate an object's elevation.

Similarly, an azimuth signal can be produced by a receiver using sequential outputs from the antenna based on right half (RH) and left half (LH) azimuth signals produced by the beam forming network. These outputs are produced by shunting one half of the antenna (for example, Q1 and Q3) or the other half (for example Q2 and Q4).

Alternately, diagonal shunting of the signals from the antenna ports can be achieved. Referring to the above table, rows 9–11 constitute switch settings for producing an output from the beam forming network representing signals from one set of diagonal quadrants of the antenna (for example, Q2 and Q3) or the other (Q1 and Q4). In the table, the row labeled diagonal left (DL) illustrates a shunting of antenna quadrants Q2 and Q3, while the row labeled diagonal right (DR) constitutes a shunting of antenna quadrants Q1 and Q4. The row labeled "Q1" illustrates the ability of the beam forming network to supply an output to a receiver via switch S9 from only a single quadrant of the antenna (for example, any of quadrants Q1–Q4).

Thus, by appropriately setting the switches S1–S9, a desired output can be produced at the output of switch S9. Alternately, in a transmit operation, the beam forming network switches can be configured to take the output from the transmitter and supply it, with selective phase shifting, to the various quadrants Q1–Q4 of the antenna. Exemplary embodiments of the beam forming network can be switched between the various outputs (for example, between the summing output, and the difference outputs used for azimuth and elevation determinations) very rapidly (for example, within five nanoseconds or faster).

As those skilled in the art will appreciate from the above table, when the switch S9 is in the "1" position, a sum transmit operation can be performed to transmit sum information from a transmitter or transceiver via the antenna. The remaining rows of the table are all directed to receive modes of operation. However, those skilled in the art will appreciate that any of these receive modes of operation can be similarly implemented as a transmit operation provided the switch S9 is transitioned from the "2" position illustrated in rows 2–11, to the "1" position.

Exemplary embodiments can achieve very low precomparator phase and gain imbalance. For example, with a 25 decibel null in the difference channels, when the switches S1–S9 are configured to produce a delta elevation or azimuth output, the phase error should be on the order of 6° or less. The implementation of a phase trimmer in each path produces a method for achieving such small phase errors. In accordance with exemplary embodiments, the gain balance between various paths is within 0.5 decibels.

Exemplary embodiments as described are suitable for any desired frequency, and can be implemented using any desired circuitry, including monolithic millimeter wave integrated circuits (MMICs). Exemplary embodiments can achieve gain on the order of 30 decibels or greater, with a bandwidth up to and exceeding 500 megahertz. Exemplary embodiments can be implemented with both linear and circular polarization, using beam widths on the order of 4.2°, or any other desired beam width. First side lobes in accordance with exemplary embodiment occur at less than −20 decibels, with other side lobes occurring at less than −25 decibels, and a delta null depth on the order of −25 decibels.

Exemplary embodiments are relatively small in size and weight, thereby adding to their desirability.

Those skilled in the art will appreciate that the present invention is not limited to the exemplary embodiments described herein. For example, rather than using the flat plate antenna described previously, a cassegrain antenna or a parabolic antenna, or any other desired antenna can be used.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for at least one of transmitting and receiving signals, comprising:

an antenna having a plurality of antenna ports; and a beam forming means for sequentially interfacing said plurality of antenna ports with a single antenna system port, said beam forming means being reconfigurable to synthesize signals at one of said plurality of antenna ports and said single antenna system port from signals at the other of said plurality of antenna ports and said single antenna system port.

2. Apparatus according to claim 1, wherein said antenna system port is configured for interfacing with a single channel of a receiver, to sequentially provide signals synthesized from outputs of said plurality of antenna ports to said receiver.

3. Apparatus according to claim 1, wherein said antenna system port is configured for interfacing with a single channel of a transmitter, to sequentially provide signals synthesized from outputs of said single antenna system port to said plurality of antenna ports.

4. Apparatus according to claim 1, wherein said beam forming means sequentially produces at least one summed signal by additively combining at least two signals from said plurality of antenna ports, and at least one difference signal by subtractively combining at least two signals from said plurality of antenna ports.

5. Apparatus according to claim 1, wherein said beam forming means includes parallel paths for interfacing at least one of said antenna ports with said signal antenna system port, wherein at least one of said parallel paths introduces a phase shift to a signal present in the path.

6. Apparatus according to claim 5, wherein one of said parallel paths is selected using at least one programmable switch.

7. Apparatus according to claim 6, wherein said programmable switch uses at least one pin diode.

8. Apparatus according to claim 5, wherein said phase shift is a 180° phase shift, and another of said parallel paths includes no such phase shift.

9. Apparatus according to claim 1, wherein said antenna is a flat plate antenna.

10. Apparatus according to claim 1, wherein said beam forming means is configured using at least one monolithic millimeter wave integrated circuit.

11. Apparatus according to claim 10, wherein said beam forming means includes a plurality of switches for selectively connecting any one or more of said antenna ports with said single antenna system port.

12. Apparatus according to claim 1, wherein said antenna is a four quadrant antenna.

13. Method for at least one of transmitting and receiving signals, comprising the steps of:

selectively interfacing multiple antenna ports of an antenna with single antenna system port; and sequentially reconfiguring a manner in which said antenna ports are interfaced with said single antenna system port to synthesize signals at one of said multiple antenna ports.

14. Method according to claim 13, wherein said antenna system port is configured for interfacing with a single channel of a receiver, to sequentially provide signals synthesized from outputs of said plurality of antenna ports to said receiver.

15. Method according to claim 13, wherein said antenna system port is configured for interfacing with a single channel of a transmitter, to sequentially provide signals synthesized from outputs of said single antenna system port to said plurality of antenna ports.

16. Method according to claim 13, comprising the step of:

sequentially producing at least one summed output by additively combining at least two signals from said plurality of antenna ports, and at least one difference signal by subtractively combining at least two signals from said plurality of antenna ports.

17. Method according to claim 13, wherein said step of sequentially reconfiguring includes a step of:

interfacing at least one of said antenna ports with said signal antenna system port via a path by selectively introducing a phase shift to a signal present in the path.

18. Method according to claim 17, wherein said phase shift is a 180° phase shift.

* * * * *

UNITED STATES PATENT AND TRADEMARK OFFICE

CERTIFICATE OF CORRECTION

PATENT NO. : 6,266,010 B1
DATED : July 24, 2001
INVENTOR(S) : Danny F. Ammar; Vernon Brady It is certified that error appears in the above-identified patent and that said Letters Patent is hereby corrected as shown below:

Column 9, claim 13,
Line 22, after "antenna ports", please insert -- and said single antenna system port from signals at the other of said multiple antenna ports and said single antenna system port --.

Signed and Sealed this

Second Day of April, 2002

*Attest:*

*Attesting Officer*

JAMES E. ROGAN
*Director of the United States Patent and Trademark Office*